US008922452B1

(12) United States Patent
O'Brien et al.

(10) Patent No.: US 8,922,452 B1
(45) Date of Patent: Dec. 30, 2014

(54) PERIODIC SPIRAL ANTENNAS

(71) Applicants: Jonathan Michael O'Brien, Brooksville, FL (US); Thomas Weller, Lutz, FL (US); Gokhan Mumcu, Tampa, FL (US); John E. Grandfield, St. Petersburg, FL (US)

(72) Inventors: Jonathan Michael O'Brien, Brooksville, FL (US); Thomas Weller, Lutz, FL (US); Gokhan Mumcu, Tampa, FL (US); John E. Grandfield, St. Petersburg, FL (US)

(73) Assignees: University of South Florida, Tampa, FL (US); The Charles Stark Draper Laboratory, Cambridge, MA (US)

( * ) Notice: Subject to any disclaimer, the term of this patent is extended or adjusted under 35 U.S.C. 154(b) by 0 days.

(21) Appl. No.: 14/221,467

(22) Filed: Mar. 21, 2014

(51) Int. Cl.
*H01Q 1/36* (2006.01)

(52) U.S. Cl.
CPC ..... *H01Q 1/36* (2013.01)
USPC ..... 343/895

(58) Field of Classification Search
CPC ..... H01Q 1/36
USPC ..... 343/895
See application file for complete search history.

(56) References Cited

U.S. PATENT DOCUMENTS

| | | | | |
|---|---|---|---|---|
| 3,106,714 | A | 10/1963 | Minerva | |
| 3,454,951 | A | 7/1969 | Patterson | |
| 3,618,114 | A * | 11/1971 | Dietrich | 343/895 |
| 3,633,210 | A * | 1/1972 | Westerman et al. | 343/895 |
| 3,717,878 | A | 2/1973 | Mosko | |
| 4,525,720 | A | 6/1985 | Corzine | |
| 4,675,690 | A * | 6/1987 | Hoffman | 343/895 |
| 5,517,206 | A | 5/1996 | Boone | |
| 6,023,250 | A * | 2/2000 | Cronyn | 343/895 |
| 6,094,176 | A | 7/2000 | Van Hoozen | |
| 2013/0194159 | A1 * | 8/2013 | Alexopoulos et al. | 343/895 |

OTHER PUBLICATIONS

Guraliuc, et al., "Numerical Analysis of a Wideband Thick Archimedean Spiral Antenna", Antennas and Wireless Propagation Letters, IEEE 11 (2012), 168-171.

Kramer, et al., "Size Reduction of a Low-Profile Spiral Antenna Using Inductive and Dielectric of Loading", IEEE Antennas and Wireless Propagation Letters, vol. 7, 2008.

Filipovic, et al, "Broadband Meanderline Slot Spiral Antenna", IEE Proc.-Microw, Antennas Propag., vol. 149, Apr. 2, 2002.

N. Apaydin, L. Zhang, K. Sertel, and J.L. Volakis, "Experimental Validation of Frozen Modes Guided on Printed Coupled Transmission Lines," IEEE Trans. Microwave Theory and Techniques, vol. 60, No. 6, pp. 1513-1519, Jun. 2012.

B. Climer, "Analysis of suspended microstrip taper baluns," Microwaves, Antennas and Propagation, IEE Proceedings H. vol. 135, part. H, No. 2, pp. 65-69, Apr. 1988.

S. Gupta and G. Mumcu, "Dual-Band Miniature Coupled Double Loop GPS Antenna Loaded with Lumped Capacitors and Inductive Pins," IEEE Trans. Antennas and Propagation, vol. 61, No. 6, pp. 2904-2910, Jun. 2013.

(Continued)

*Primary Examiner* — Hoang V Nguyen
(74) *Attorney, Agent, or Firm* — Thomas | Horstemeyer, LLP

(57) ABSTRACT

In one embodiment, a periodic spiral antenna includes first and second arms that form interleaved spirals parallel to an x-y plane, wherein the arms have a height dimension that extends along a z direction that is perpendicular to the x-y plane, and wherein the interleaved spirals form multiple turns of the antenna, the turns being equally spaced from each other throughout the antenna.

16 Claims, 9 Drawing Sheets

(56) References Cited

OTHER PUBLICATIONS

B.A. Kramer, M. Lee, C-C. Chen, and J.L.Volakis, "Design and performance of an ultrawide-band ceramic-loaded slot spiral," IEEE Trans. Antennas and Propagation, vol. 53, No. 7, pp. 2193-2199, Jul. 2005.

M.S. Wheeler, "On the radiation from several regions in spiral antennas," IRE Trans. Antennas and Propagation, vol. 9, No. 1, pp. 100-102, Jan. 1961.

L. Ming, B.A. Kramer, C-C. Chen, and J. L. Volakis, "Distributed lumped loads and lossy transmission line model for wideband spiral antenna miniaturization and characterization," IEEE Trans. Antennas and Propagation, vol. 55, No. 10, pp. 2671-3678, Oct. 2007.

H. Nakano, K. Kikkawa, Y. Litsuka, and J. Yamauchi, "Equiangular spiral antenna backed by a shallow cavity with absorbing strips," IEEE Trans. Antennas and Propagation, vol. 56, No. 8, pp. 2742-2747, Aug. 2008.

H. Nakano, K. Kikkawa, Y. Litsuka, and J. Yamauchi, "Low-profile equiangular spiral antenna backed by an EBG reflector," IEEE Trans. Antennas and Propagation, vol. 57, No. 5, pp. 1309-1318, May 2009.

Wang, Johnson J.H., "The spiral as a traveling wave structure for broadband antenna applications," Electromagnetics, vol. 20, No. 4, pp. 323-342, Oct. 2010.

J.M. O'Brien, E. Rojas, and T.M. Weller, "A switched-line phase shifter fabricated with additive manufacturing," in International Microelectronics Assembly and Packaging Society, Orlando, FL, 2013.

Stratasys, "Stratasys Production Series," Nov. 2013, web, <http://www.stratasys.com/3dprinters/production-series>.

Tanabe, M.; Komukai Complex, Toshiba Corp., Kawasaki, Japan; Matsumoto, M. ; Masuda, Y. "A two-arm Archimedean spiral antenna with bent ends", Antennas and Propagation in Wireless Communications (APWC), 2012 IEEE-APS Topical Conference on Sep. 2-7, 2012. pp. 535-538.

* cited by examiner

PERIODIC SPIRAL ANTENNAS

BACKGROUND

Efficient miniaturization of ultra-wideband (UWB) antennas is of interest for applications that place a restriction on aperture size and volume. Various techniques can be employed to reduce wave velocity and thus shrink the antenna footprint, including meandering of the antenna to increase inductance per unit length and utilizing high permittivity substrates. Other techniques have been investigated that load the arms of a spiral with lumped elements to reduce the wave velocity. Unfortunately, the miniaturization that these techniques provide comes at the cost of antenna performance, such as decreased efficiency. In view of this, it can be appreciated that it would be desirable to have an alternative way to miniaturize an antenna.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have an alternative way to miniaturize an antenna. Disclosed herein are miniaturized, three-dimensional, periodic spiral antennas that have a height (z) dimension that is used to inductively load the antenna while maintaining uniform capacitance. In some embodiments, this is achieved by sinusoidally varying the shape (height) of the antenna in the z direction and maintaining a constant distance between arms of the spiral through each turn of the antenna such that the spiral is an Archimedean spiral. In further embodiments, both the amplitude and period of the sinusoidal shape increase along the lengths of the antenna arms from the center of the spiral toward its outer edges. In still further embodiments, the period of the sinusoidal shape increases linearly such that the peaks and troughs of the various turns of the antenna radially align with each other.

In the following disclosure, various specific embodiments are described. It is to be understood that those embodiments are example implementations of the disclosed inventions and that alternative embodiments are possible. All such embodiments are intended to fall within the scope of this disclosure.

Described in this disclosure is a volumetric approach for miniaturizing an ultra-wideband (UWB) spiral antenna. The combination of a periodic spiral antenna that utilizes the z direction and a tapered substrate profile provides for volumetric miniaturization. In this new design, the distributed inductance and capacitance, and therefore the impedance match, are tightly controlled as the footprint is miniaturized by utilizing all three spatial dimensions.

Figure 1:
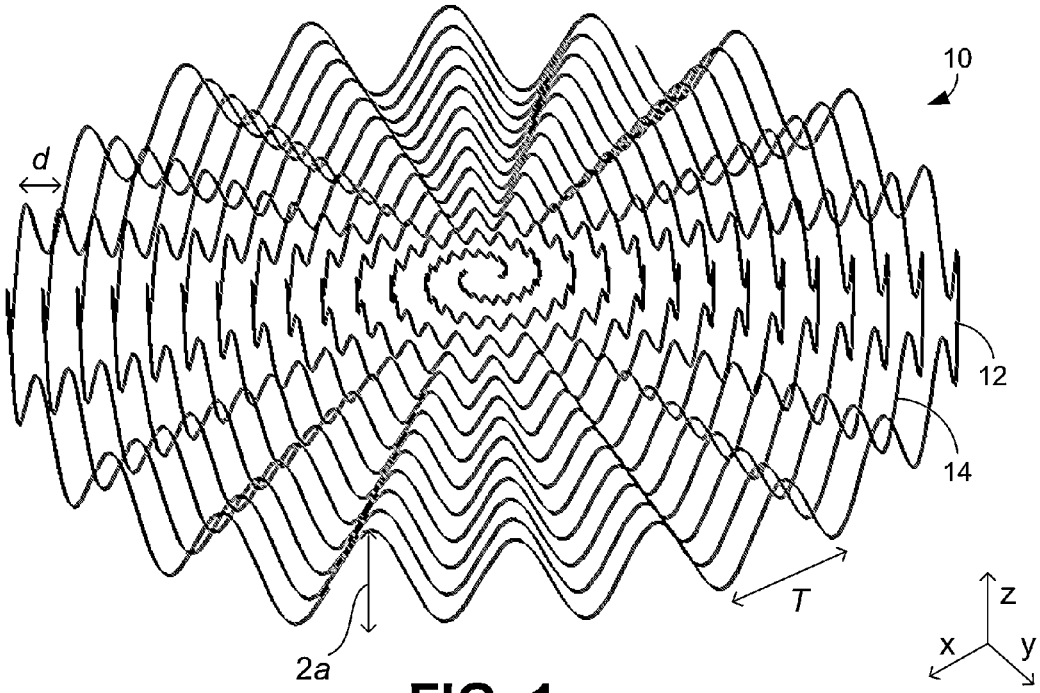
FIG. 1 is a perspective top view of an embodiment of a periodic spiral antenna.
Figure 2:
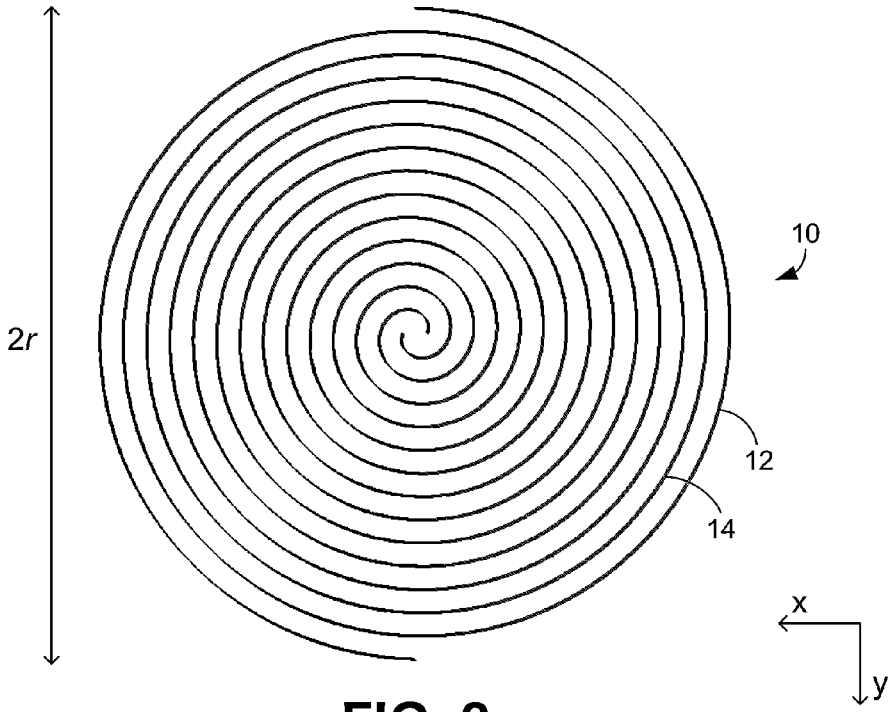
FIG. 2 is a top view of the periodic spiral antenna of FIG. 1.

FIGS. 1 and 2 illustrate an embodiment of a periodic spiral antenna 10 having a radius, r. The antenna 10 comprises first and second arms 12 and 14 that spiral out from the center of the antenna in opposite directions so as to define independent spirals that are interleaved with each other and parallel to an x-y plane. Each of the arms 12, 14 is made of an electrically conductive material and, in some embodiments, has a constant width, w (see FIG. 3). The spiral defined by each arm 12, 14 passes through multiple turns. As used herein, a full turn is completed when an arm 12, 14 makes a full 360° rotation. In the illustrated example, the arms 12, 14 each make 7 such turns. Each of the arms 12, 14 has an Archimedean growth rate (i.e., each is an Archimedean spiral) so that the distance, d, between each of the arms is constant across the entire antenna 10.

As is apparent from FIG. 1, each of the arms 12, 14 has a sinusoidal shape that is achieved by modulating the height (in the z direction) of the arms in a sinusoidal manner as a function of angular position. This sinusoidal shape has an amplitude (i.e., maximum amplitude), a, and the distance between peak to trough is 2a. As is apparent from the figure, the amplitude, a, continuously increases along the lengths of the arms 12, 14 as the spirals are traversed from the center of the antenna 10 such that the amplitude is smallest in the center of and largest at the edges of the antenna.

With further reference to FIG. 1, the period, T, of the sinusoidal shape also continuously increases along the lengths of the arms 12, 14 from the center of the antenna 10 such that the period is smallest in the center of and largest at the edges of the antenna. Moreover, the period, T, increases at a constant rate such that the peaks and troughs of the arms 12, 14 throughout each turn of the antenna 10 radially align with each other. In the illustrated example, each turn of each arm 12, 14 comprises 20 such periods.

The dimensions of the antenna 10 can be varied depending upon the application. In some embodiments, however, the radius (r) of the antenna 10 can be approximately 0.10 to 1000 mm, the width (w) of each arm 12, 14 can be approximately 0.25 to 4 mm, the distance (d) between the arms can be approximately 1 to 5 mm, the amplitude (a) of the sinusoid can be approximately 0 to 16 mm, and the period (T) of the sinusoid can be approximately 0 to 30 mm.

A significant advantage of the periodic spiral antenna 10 is that the z dimension is used to inductively load the antenna while maintaining uniform spacing, and therefore capacitance, between the arms 12, 14. This capacitance is an important factor in maintaining performance because of the close arm-to-arm spacing created by the Archimedean growth rate. Since the input impedance of the antenna 10 is controlled by the amount of inductance and capacitance along the arms 12, 14, any rapid changes in either of these values will cause reflections that degrade the wideband return loss performance. This design approach therefore enables miniaturization of the antenna 10 while still maintaining the performance that is characteristic of a traditional Archimedean spiral. The example antenna 10 shown in FIGS. 1 and 2 achieves a 0 dB gain miniaturization factor of 1.46 by using a combination of z-plane meandering and dielectric loading.

The antenna 10 radiates when the signals in adjacent arms 12, 14 are in phase, thereby creating constructive interference in the far-field of the antenna. This leads to the concept of radiation "bands" within the spiral, in which each band effectively creates a loop that is $\lambda_g$ in circumference. From this concept it can be appreciated that the high frequency limit is created by the resolution of the inner turns and the low frequency limit is controlled by the outer turns of the antenna 10. When applying miniaturization to a spiral antenna, it is desirable to decrease the wave velocity at the low frequency portion of the spiral while leaving the high frequency portion unmodified. Ideally, this will decrease the low frequency operational point of the antenna while leaving the high frequency operational point intact. Often this low frequency expansion is achieved by designing a tapered substrate that increases in height as it approaches the outer portion of the spiral, thereby concentrating higher levels of dielectric loading at the low frequency region of the spiral.

As described above, the periodic spiral antenna 10 is formed by modulating the height of its arms 12, 14 in a sinusoidal fashion as a function of angular position or distance. The shape of the antenna 10 can best be described in cylindrical coordinates by Equation 1

$$\vec{r} = A\phi\hat{\rho} + f(\phi)\hat{z} \qquad \text{[Equation 1]}$$

where $\vec{r}$ is the radius vector forming the antenna, A is the Archimedean growth rate, $\phi$ is the angular distance in the x-y plane, $\hat{\rho}$ is the angular axis in the cylindrical coordinate system, $f(\phi)$ is a generic function of $\phi$, and $\hat{z}$ is the z axis in the cylindrical coordinate system. In Equation 1, $f(\phi)$ can take various different forms. For example, it can be $$A\phi \sin(\phi) \qquad \text{[Equation 2]}$$

for linear growth, $$B\phi^{\gamma} \sin(\phi) \qquad \text{[Equation 3]}$$

for exponential growth, or $$C \arctan(x)\phi \sin(\phi) \qquad \text{[Equation 4]}$$

for Sigmoid growth.

Figure 3:
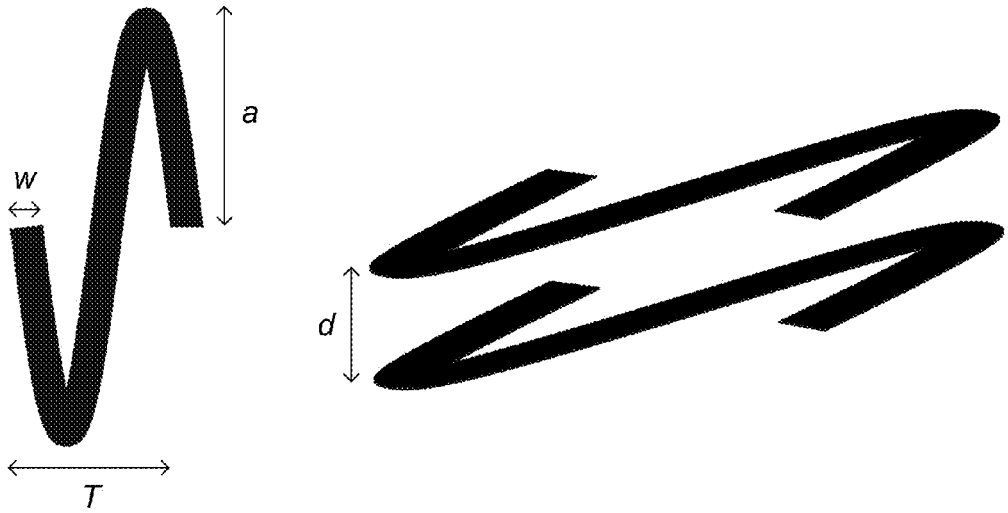
FIG. 3 is a drawing of a unit cell of the periodic spiral antenna of FIGS. 1 and 2.
Figure 4:
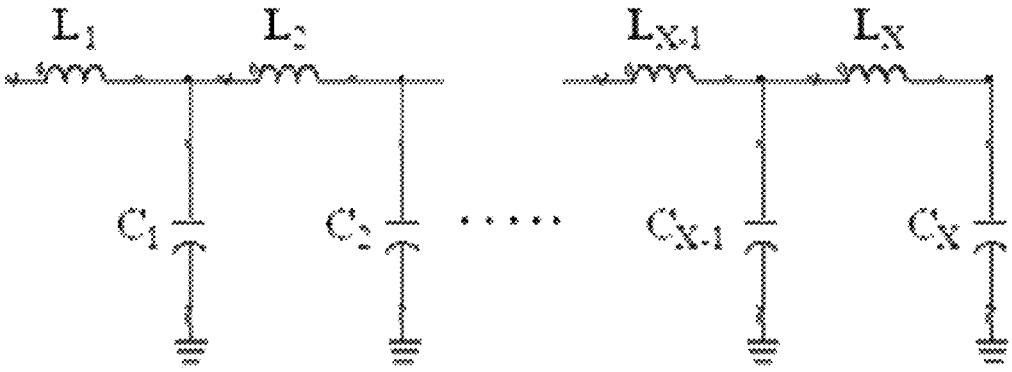
FIG. 4 is an equivalent circuit model for the periodic spiral antenna of FIGS. 1 and 2 assuming PEC traces and a lossless substrate where X is the number of LC sections required.

As shown in FIG. 3, a unit cell of the periodic spiral antenna having a period (T) was modeled to characterize the contribution of each parameter to the overall antenna miniaturization. This unit cell was used to change the period between 6.28 mm and 12.57 mm while varying the amplitude from 0 mm to 12 mm. The s-parameters obtained from the unit cell extraction were then fit to the scattering matrix of an equivalent circuit model shown in FIG. 4. The equivalent circuit model was used to show that meandering in the z dimension increases both the inductance and capacitance as a function of height, creating a smooth introduction of miniaturization and reducing reflections when applied to the periodic spiral antenna.

The coupling between adjacent oscillations on the same transmission line is important in the antenna. Therefore, the unit cell is extracted from a more complicated model. With this method, a larger model is simulated consisting of N unit cells cascaded together and another model is then simulated consisting of N−1 unit cells. The transfer matrix of the larger model was then divided by the smaller model resulting in the transfer matrix of a single unit cell. This enabled any inaccuracies due to the truncation of the structure to be reduced and the single unit cell to be more accurately modeled as it is in the antenna.

Figure 5:
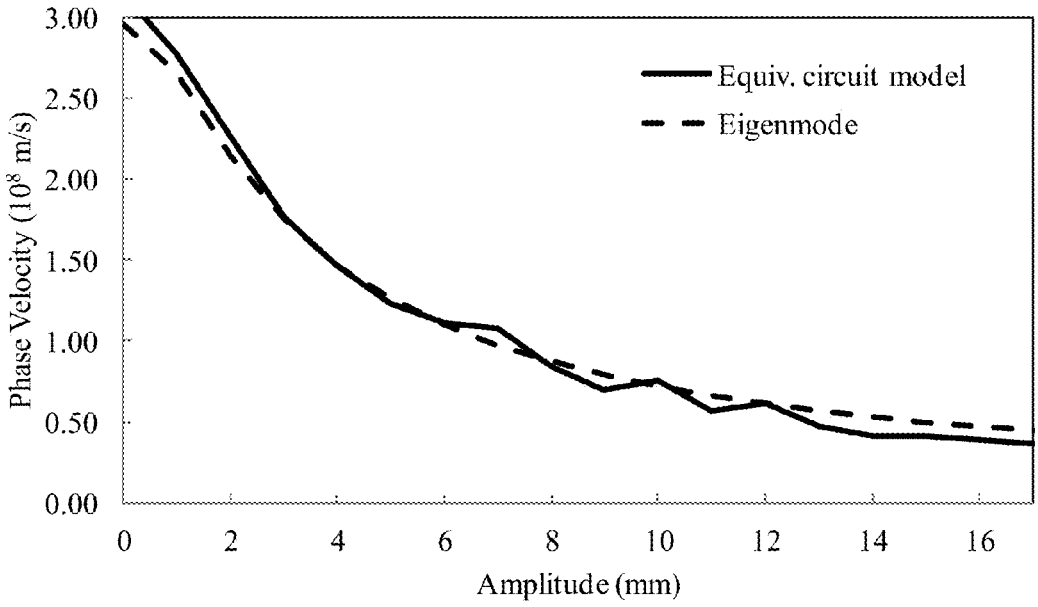
FIG. 5 is a graph that compares phase velocity using the equivalent circuit model of FIG. 4 and an eigenmode simulation as a function of amplitude for a periodic spiral antenna with a conductor spacing of 2.54 mm and a period of 6.28 mm.

HFSS 15.0 software was used to simulate the unit cell and each arm was fed with opposite currents. This assumes a relationship exists between the non-radiating portion of the spiral, which has out-of-phase currents, and the radiating portion of the spiral, which has in-phase currents. To prove the accuracy of this method and the equivalent circuit model, an eigenmode simulation was performed with the HFSS 15.0 software and the phase velocity was calculated from the results. Because this is known as the most accurate way to calculate phase velocity along a transmission line, it was used as the benchmark for comparison against the phase velocity calculated from the inductance and capacitance present in the equivalent circuit model. Comparison results of the two methods can be seen in FIG. 5. This data shows that, as amplitude is increased, the phase velocity is reduced with a diminishing effect at higher amplitudes.

The Archimedean growth rate (A) controls the spacing between arms and therefore the amount of capacitance per unit length along the arm. Because the arms are oriented parallel to each other, the capacitive coupling between arms is increased. Orienting the arms in this manner also enables the Archimedean growth rate to be decreased, further increasing the capacitance and therefore miniaturization.

Figure 6:
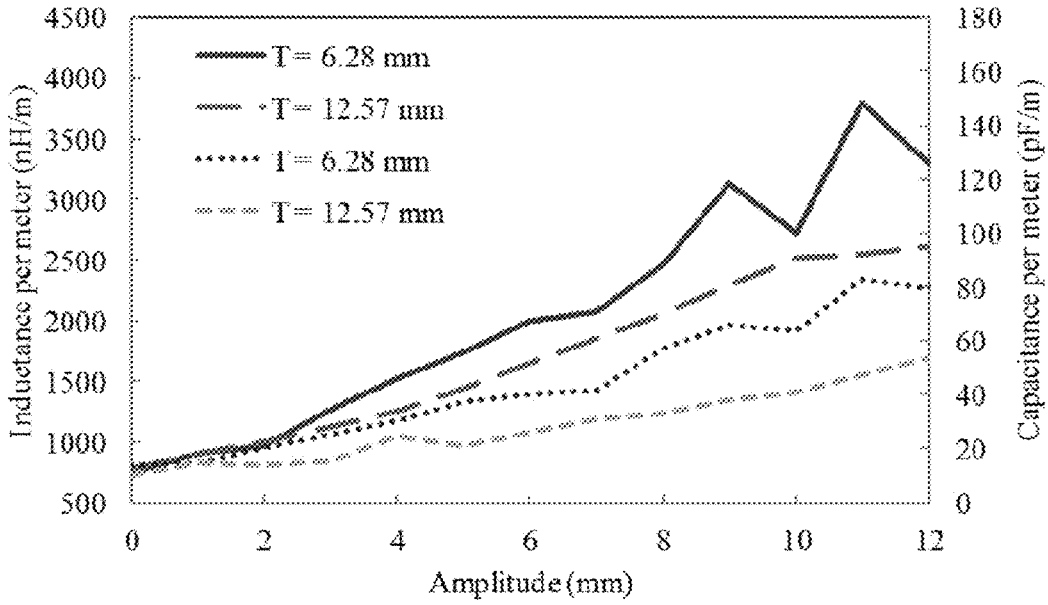
FIG. 6 is a graph that shows inductance and capacitance per meter as a function of amplitude for a periodic spiral antenna with a period of 6.28 mm and 12.57 mm and a conductor spacing of 2.54 mm.

The amplitude growth rate (B) and the number of oscillations per turn (N) have an effect on the amount of effective inductance and capacitance that is added. The number of oscillations per turn can be thought of as the parameter that controls the maximum amount of miniaturization available while the amplitude growth rate controls the actual miniaturization achieved. This means that, for a specified, achievable, miniaturization factor, there are two sets of parameters, including an amplitude growth rate and number of oscillations per turn, which will yield the same result. One set will contain a larger amplitude growth rate factor with a lower number of oscillations and the other will contain a lower amplitude growth rate factor with a higher number of turns. The benefit of choosing the combination with a smaller amplitude growth factor is a smaller overall height of the antenna. In situations in which the antenna will be backed by a shallow cavity and there is a restriction on overall height, this option will keep the antenna farther away from the cavity base, thereby reducing unwanted deviations in the antenna parameters. The second combination will have a smaller number of oscillations but a larger overall height profile. The unit cell was used to study how inductance and capacitance change as a function of amplitude and period. Results of this study can be seen in FIG. 6. This data shows that both the inductance and capacitance are increased as a function of amplitude leading to the conclusion that z-plane meandering will be effective when applied to the Archimedean spiral antenna.

Figure 7:
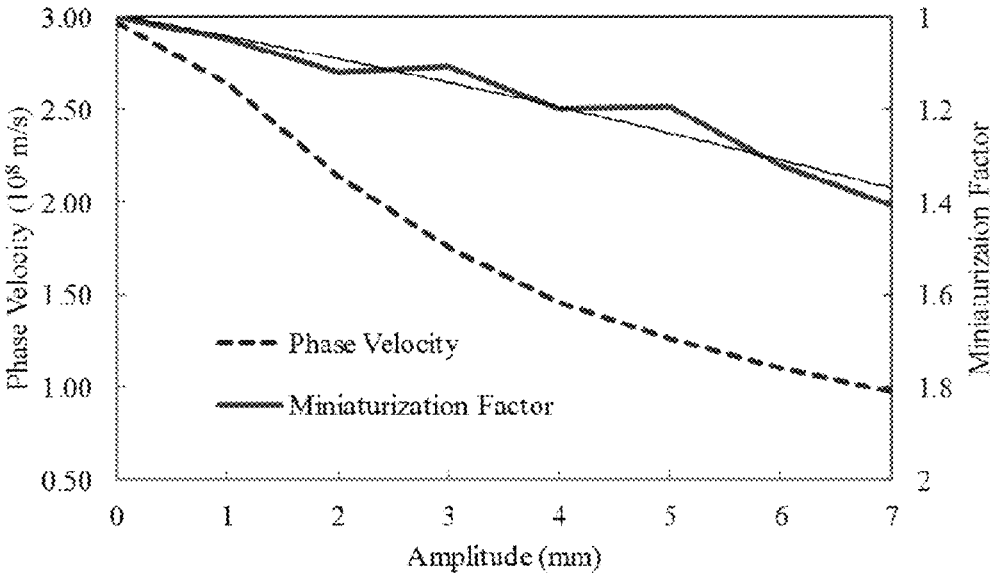
FIG. 7 is a graph that shows phase velocity and corresponding miniaturization factor versus outer amplitude for a periodic spiral antenna with a conductor spacing of 2.54 mm and a period of 6.28 mm.

A spiral antenna is not a resonant antenna. Therefore, the miniaturization factor is not equal to the reduction in phase velocity. By using an eigenmode simulation of the unit cell to calculate the phase velocity and a full wave simulation of the PSA model to calculate the miniaturization factor, a comparison can be made. For this study, the outer portion of the periodic spiral antenna maintained the same physical dimensions as the unit cell. FIG. 7 shows the miniaturization factor being approximated with a linear relationship. When applying a large amount of miniaturization, the return loss of the antenna begins to degrade, resulting in a smaller shift in the 0 dB realized gain point per incremental increase in amplitude.

In applications in which unidirectional radiation is desired, a cavity can be used to suppress the back lobe level. When using a shallow cavity, the wideband characteristics inherent to a spiral antenna deteriorate. This deterioration occurs because the waves reflected off the cavity have a reverse direction as compared to the antenna element, thereby causing undesired effects in the far field. This becomes evident with the degradation in axial ratio and return loss. To remedy this, studies have been performed that add a lossy ring around the outside walls of the cavity to absorb energy present at the tip and reduce reflections. Optimization of the shape of the absorbing ring can reduce the reduction in efficiency, while maintaining improved axial ratio and return loss. Other methods such as using an electromagnetic band-gap (EBG) reflector around the spiral have shown benefits in restoring the performance of a spiral antenna but require a larger footprint to implement.

Figure 8:
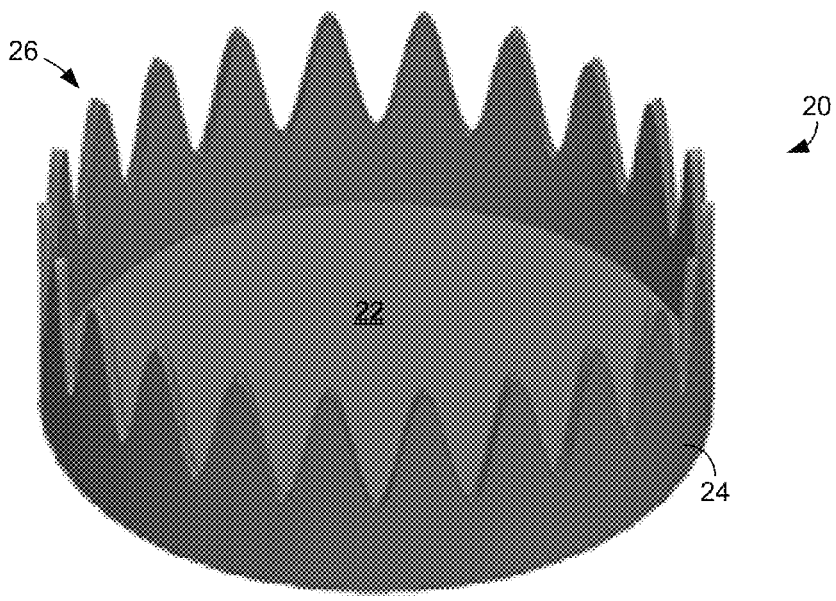
FIG. 8 is a perspective view of an embodiment of an antenna cavity that can be used with a periodic spiral antenna.
Figure 9:
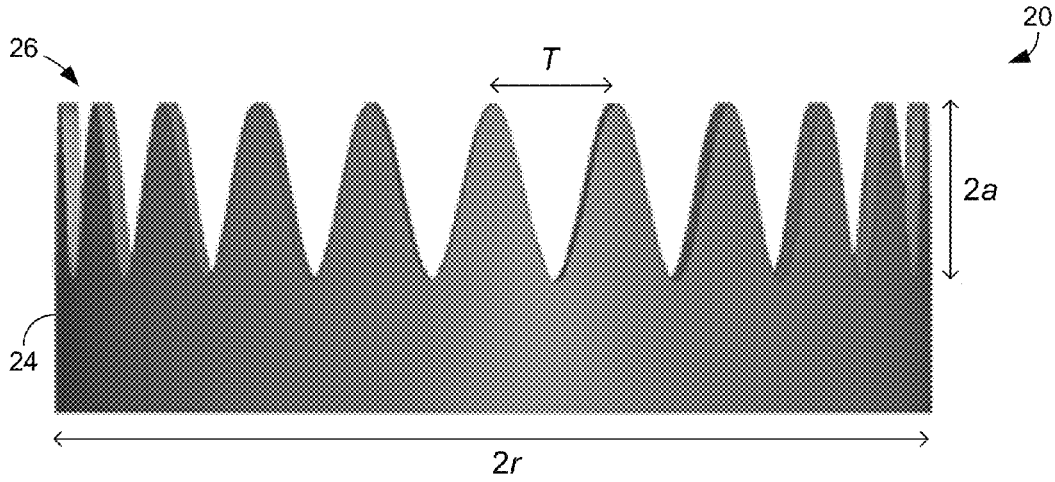
FIG. 9 is a side view of the antenna cavity of FIG. 8.

For the periodic spiral antenna, the distance between the arms of the antenna and the sidewalls of the cavity varies. The sinusoidal troughs of the antenna element will get closer to the cavity walls and can cause power to be transferred to the grounded cavity. To remedy this effect, a cavity was designed having a sidewall that has the same sinusoidal shape as the periodic spiral antenna. As shown in FIGS. 8 and 9, the cavity 20 comprises a circular base 22 and a continuous circular sidewall 24, which are both made of an electrically conductive material. The sidewall 24 extends upward from the edges of the base 22 and has a top edge 26 that is circular in the x-y plane and sinusoidal in the z direction. The base 22 has a radius (r) and the sinusoidal shape of the top edge has an amplitude (a) and a period (T), which may be different from a and T of the periodic spiral antenna.

Figure 10:
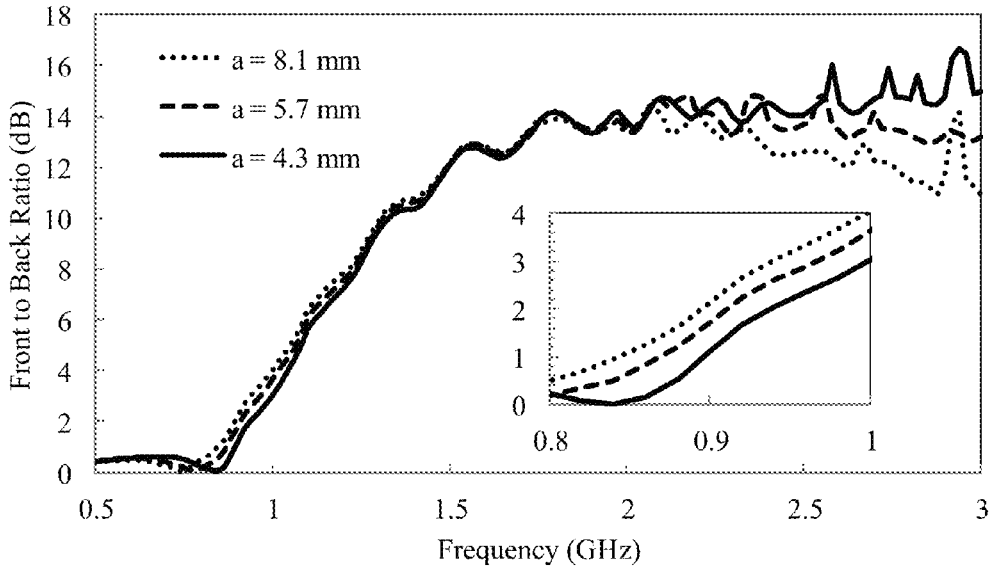
FIG. 10 is a graph that shows the front-to-back ratio of a cavity-backed periodic spiral antenna with different amplitudes of oscillations on the cavity walls.
Figure 11:
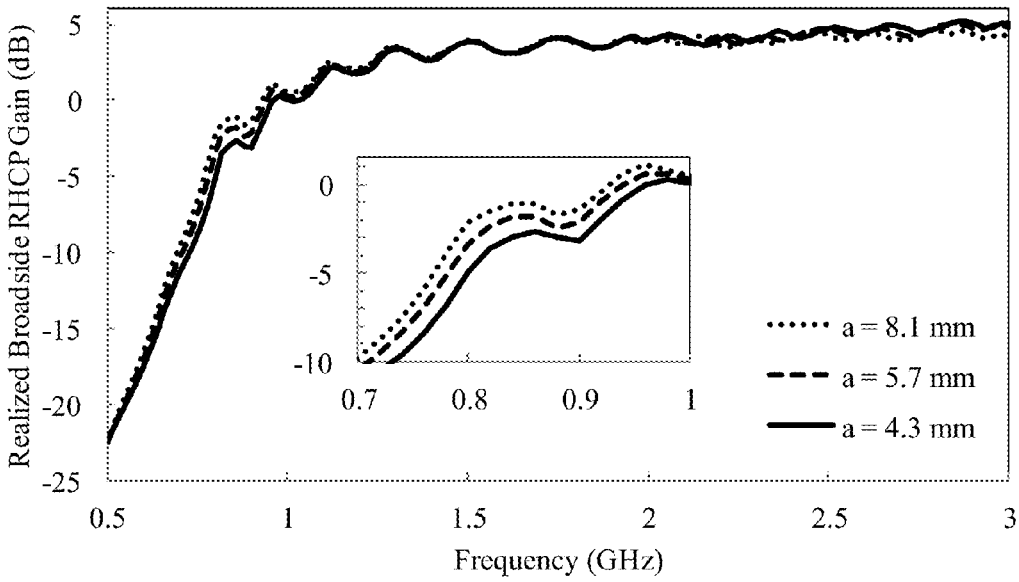
FIG. 11 is a graph that shows the broadside gain of a cavity-backed periodic spiral antenna with different amplitudes of oscillations on the cavity walls.
Figure 12:
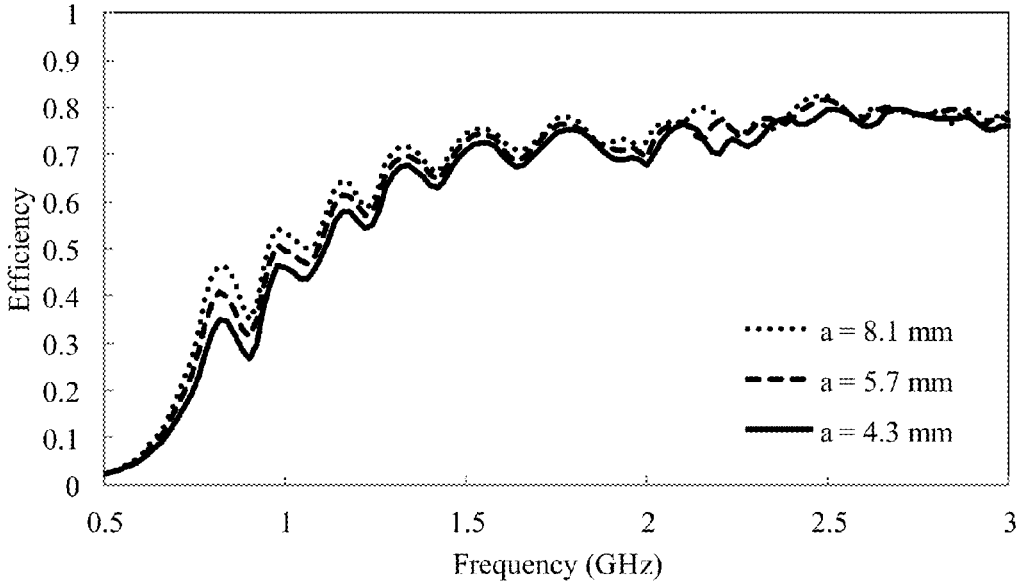
FIG. 12 is a graph that shows the return loss of a cavity-backed periodic spiral antenna with different amplitudes of oscillations on the cavity walls.
Figure 13:
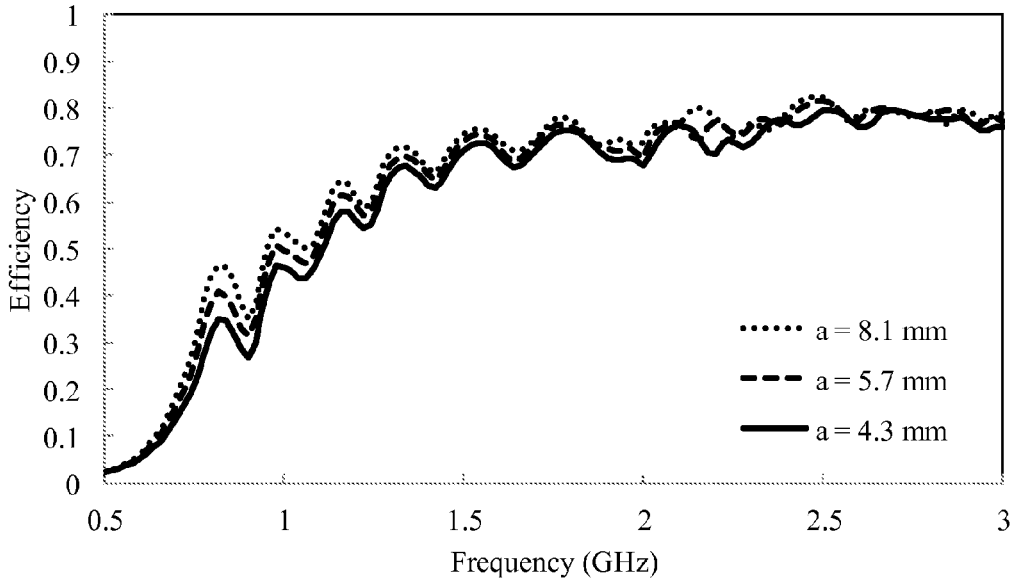
FIG. 13 is a graph that shows the efficiency of a cavity-backed periodic spiral antenna with different amplitudes of oscillations on the cavity walls.

Simulation has shown that implementing this sinusoidal shape on the top edge of the cavity sidewalls results in improvements to the return loss and gain with little sacrifice in the front to back ratio. Furthermore, the amplitude of oscillation of the sidewall of the cavity can be optimized to improve return loss and broadside gain. FIGS. 10-13 show the effect of maintaining the same distance between the antenna and the top edge while adjusting the amplitude a of oscillation of the cavity sidewall between 4.3 mm (equal to the amplitude of the fabricated antenna) and 8.1 mm. FIG. 10 shows that the front-to-back ratio improves when the amplitude a is increased on the top edge of the sidewall. The broadside gain, shown in FIG. 11, is improved by 3 dB at 800 MHz, while the high frequency gain is maintained. This increase can be attributed to the improvement in return loss and efficiency as the amplitude of the cavity is increased (see FIGS. 12 and 13). Due to the effect of portions of the cavity being spaced farther from the antenna, the efficiency will increase in the low frequency portion of the antenna, as shown in FIG. 13.

Figure 14:
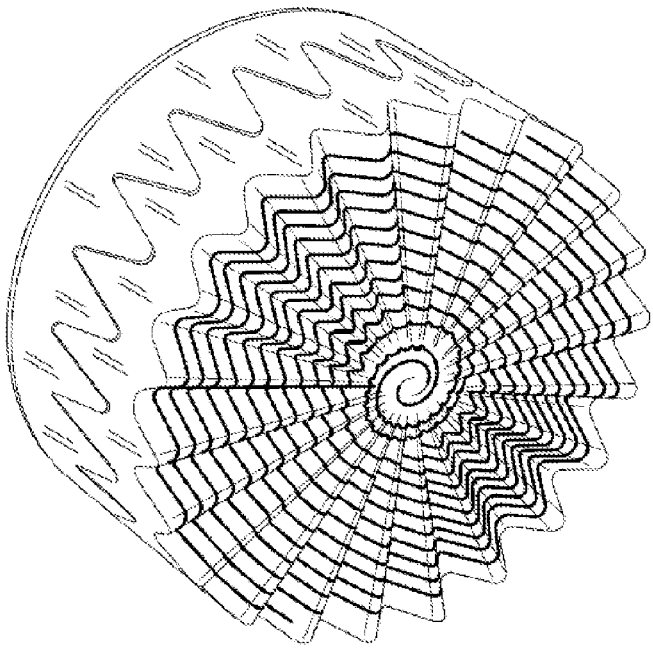
FIG. 14 is a photograph of a fabricated model of a cavity-backed periodic spiral antenna.

The disclosed periodic spiral antennas can be fabricated using various techniques. FIG. 14 shows a photograph of an example antenna that was fabricated using an ULTEM™ substrate ($\in_r$=2.75), which has low-loss radio frequency (RF) performance comparable to high quality microwave laminates. The substrate was printed with a Fortus 400mc fused deposition modeling tool in a manner in which the top surface of the substrate had a corrugated surface that defines the sinusoidal shape of periodic spiral antenna. A groove was then formed in the corrugated surface and a 0.81 mm (32 mils) diameter copper wire was placed in the groove. This size of wire enables the antenna to handle 30 W of power.

The fabricated model shown in FIG. 14 has a diameter of 3" and a height of 1.5" measured from the bottom of the cavity to the top of the substrate. Its antenna has an Archimedean growth rate (A) of 0.08 cm, an amplitude growth rate (B) of 0.09 mm, a number of oscillations (N) of 22, and $\phi$ is swept from 0 to $14\pi$. To feed the antenna model, a tapered balun was fabricated on Rogers RO4360G2. The balun was used to transform the input impedance of the antenna to 50Ω and change the electric fields from the unbalanced coaxial feed to the balanced field distribution required for the antenna.

Figure 15:
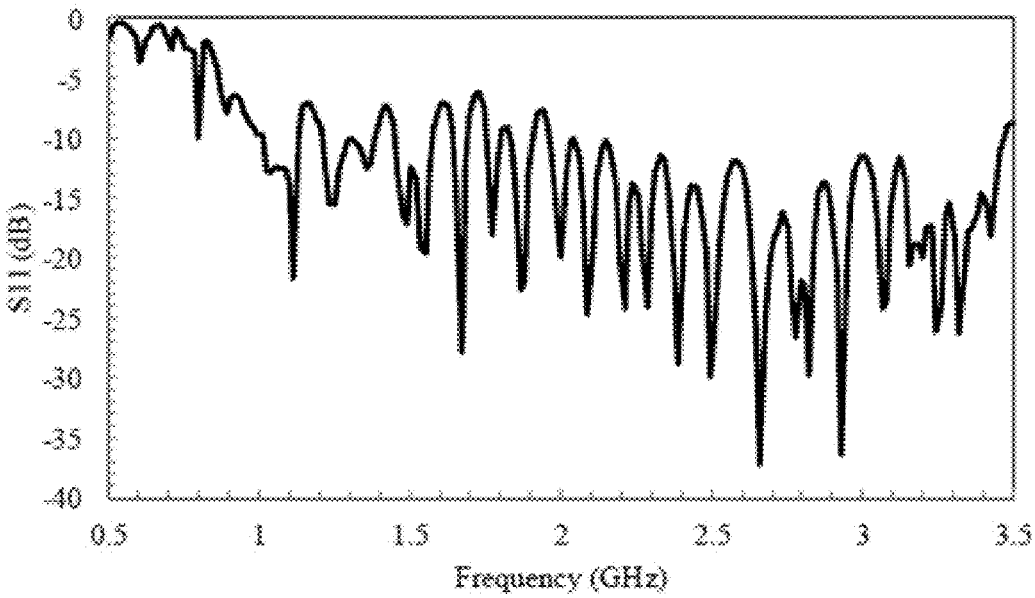
FIG. 15 is a graph that shows the measured return loss of a cavity-backed periodic spiral antenna.
Figure 16:
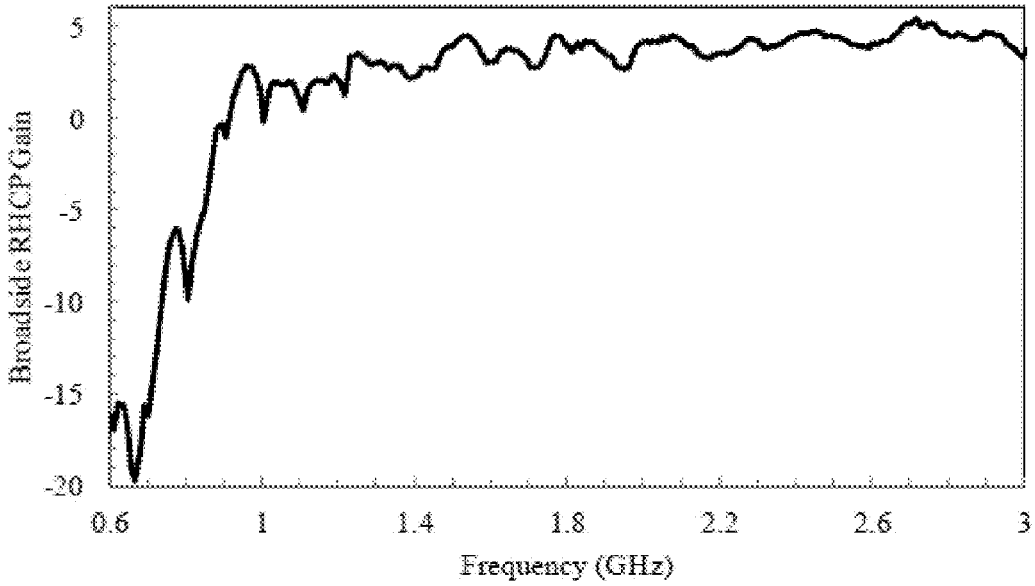
FIG. 16 is a graph that shows the measured right hand circularly polarized (RHCP) gain of a cavity-backed periodic spiral antenna.
Figure 17:
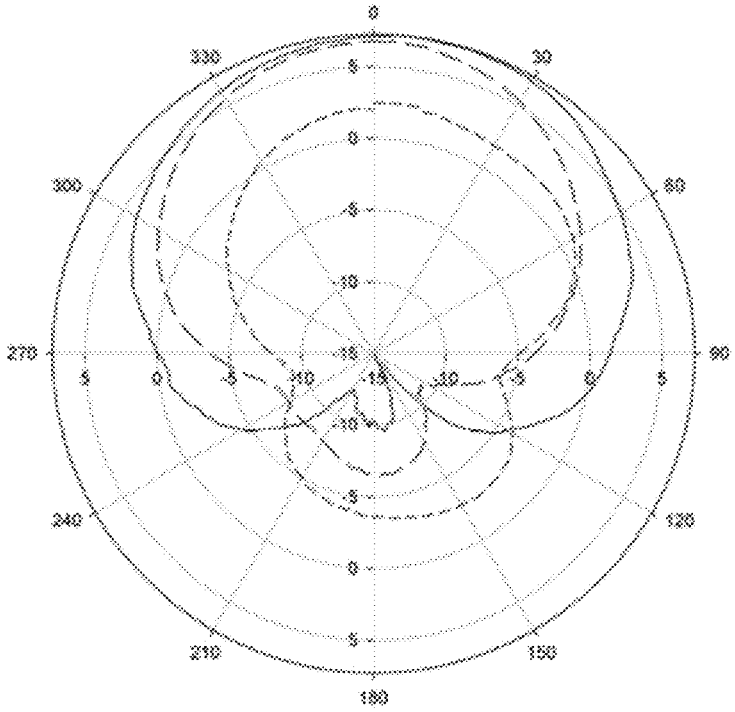
FIG. 17 is a graph that shows the measured total gain radiation pattern for a cavity-backed periodic spiral antenna at 1.0 GHz, 1.5 GHz, and 2.4 GHz.

The return loss of the fabricated antenna was measured with an Agilent 8720E vector network analyzer, shown in FIG. 15. FIG. 16 shows the results of the broadside RHCP gain, which was measured in an anechoic chamber. This figure shows a 0 dB gain point of 917 MHz. An elevation cut at multiple frequencies can be seen be seen in FIG. 17, which confirms unidirectional radiation.

Figure 18:
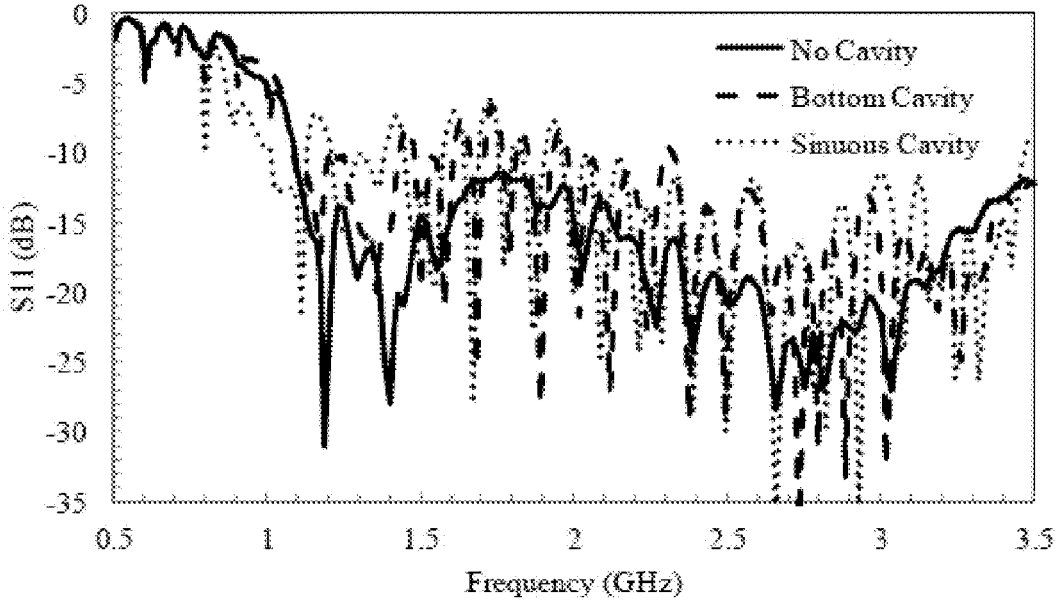
FIG. 18 is a graph that shows the return loss of a periodic spiral antenna using three different cavity configurations.

To show how return loss is affected when using a sinuous cavity of the type shown in FIGS. 8 and 9, the fabricated antenna was measured in three different configurations: without the cavity (dielectric loaded), with a flat cavity along the bottom of the substrate (back cavity), and a full sinuous cavity. The return loss measurements are shown in FIG. 18. Comparison of the return loss measurements of the version with the back cavity and the full sinuous cavity shows the improvements made by adding the sinuous sidewall to the cavity. For example, at 1 GHz the return loss of the back cavity and full cavity models were 4.25 dB and 9.75 dB, respectfully, showing an improvement of 5.5 dB. The improvement in return loss when adding the sinuous sidewall to the cavity also comes with an improvement in the front-to-back ratio.

The invention claimed is:

1. A periodic spiral antenna comprising:

first and second arms that form interleaved spirals parallel to an x-y plane, wherein the arms have a height dimension that extends along a z direction that is perpendicular to the x-y plane, the heights of the arms varying as a sinusoidal function of angular position such that each of the arms has a sinusoidal shape, and wherein the interleaved spirals form multiple turns of the antenna, the turns being equally spaced from each other throughout the antenna.

2. The antenna of claim 1, wherein the first and second arms spiral out from a center of the antenna in opposite directions.

3. The antenna of claim 1, wherein the interleaved spirals formed by the arms each have an Archimedean growth rate.

4. The antenna of claim 1, wherein an amplitude of each sinusoidal shape continuously increases along the lengths of the arms from a center of the antenna.

5. The antenna of claim 4, wherein the amplitude linearly increases along the lengths of the arms.

6. The antenna of claim 4, wherein the amplitude exponentially increases along the lengths of the arms.

7. The antenna of claim 1, wherein a period of each sinusoidal shape continuously increases along the lengths of the arms from a center of the antenna.

8. The antenna of claim 7, wherein the period linearly increases along the lengths of the arms.

9. The antenna of claim 8, wherein the arms form multiple turns of the antenna and wherein peaks and troughs of the sinusoidal shapes radially align across the turns.

10. The antenna of claim 1, wherein the shape of each arm is defined by the following equation:

$$\vec{r} = A\phi\hat{\rho} + f(\phi)\hat{z}$$

where $\vec{r}$ is a radius vector of the arm, A is the Archimedean growth rate, $\phi$ is the angular distance in the x-y plane, $\hat{\rho}$ is the angular axis in the cylindrical coordinate system, $f(\phi)$ is a generic function of $\phi$, and $\hat{z}$ is the z axis in the cylindrical coordinate system.

11. The antenna of claim 10, wherein the cavity comprises a base positioned on the bottom surface and a sidewall that extends along a side of the substrate toward the arms, wherein a top edge of the sidewall has a sinusoidal shape that matches the sinusoidal shapes of the arms.

12. The antenna of claim 1, further comprising a substrate having a top surface upon which the arms are provided.

13. The antenna of claim 12, further comprising a cavity provided on a bottom surface of the substrate that suppresses radiation from the arms.

14. A three-dimensional periodic spiral antenna comprising:

first and second arms that spiral out from a center of the antenna at an Archimedean growth rate and form interleaved spirals parallel to an x-y plane, wherein heights of the arms sinusoidally vary as a function of angular position such that the arms each have a sinusoidal shape that has an amplitude in a z direction that is perpendicular to the x-y plane;

wherein the interleaved spirals form multiple turns of the antenna, the turns being equally spaced from each other throughout the antenna;

wherein the amplitude of the sinusoidal shape continuously increases along the lengths of the arms from a center of the antenna; and wherein a period of the sinusoidal shape continuously increases along the lengths of the arms from the center of the antenna.

15. The antenna of claim 14, wherein the amplitude linearly or exponentially increases along the lengths of the arms.

16. The antenna of claim 14, wherein the arms form multiple turns of the antenna and wherein peaks and troughs of the sinusoidal shapes radially align across the turns.

* * * * *